US005555561A

United States Patent [19]

Plachta et al.

[11] Patent Number: 5,555,561

[45] Date of Patent: Sep. 17, 1996

[54] CUFF SEAL FOR ANTI-CONTAMINATION PROTECTIVE GARMENTS

[75] Inventors: Christopher Plachta, Kalamazoo; Gregory L. Bain, Watervliet, both of Mich.

[73] Assignee: Traak, Inc., Kalamazoo, Mich.

[21] Appl. No.: 82,396

[22] Filed: Jun. 28, 1993

[51] Int. Cl.[6] ..... A41D 13/00

[52] U.S. Cl. ..... 2/2; 2/60; 2/270; 2/901

[58] Field of Search ..... 2/16, 22, 23, 59, 2/60, 61, 170, 311, 312, 321, 901, 270, 162, 2

[56] References Cited

U.S. PATENT DOCUMENTS

| | | | |
|---|---|---|---|
| 1,612,055 | 12/1926 | Rice | 2/162 X |
| 3,381,989 | 5/1968 | Thomas | 2/162 X |
| 3,594,817 | 7/1971 | Kelly | 2/23 X |
| 3,889,297 | 6/1975 | Jarboe et al. | 2/16 |
| 4,601,066 | 7/1986 | Campbell | 2/270 X |
| 4,905,321 | 3/1990 | Walunga | 2/162 X |
| 5,073,988 | 12/1991 | Lewis, Jr. et al. | 2/162 |

*Primary Examiner*—Paul C. Lewis

*Attorney, Agent, or Firm*—Waters & Morse, P.C.

[57] ABSTRACT

A cuff seal for sealing the cuffs of anti-contamination protective clothing having cuffs at the distal ends of arms and legs comprises an elongated band that is removably attached to the cuff at an inner end and wraps around the cuff and is attached to the cuff where it overlaps the band at an outer end of the band. The band is fastened to the cuff and to the band itself by spaced pairs of snap fasteners. The band is formed of a stretchable woven fabric which includes an elastomeric yarn in addition to non-elastomeric yarn in order to provide at least a limited stretch capability for the fabric. The band is about two inches wide and covers the arm cuff completely and extends distally beyond the arm cuff so as to provide a snug seal between the band and the wearer's glove at a position distally separated from the cuff. The band similarly encircles the limb of the wearer at the cuff of the coverall legs. The band includes a plurality of longitudinally spaced snaps so that the same band can be used for different sized limbs of different wearers.

13 Claims, 3 Drawing Sheets

CUFF SEAL FOR ANTI-CONTAMINATION PROTECTIVE GARMENTS

BACKGROUND OF THE INVENTION

There are a number of applications where persons are required to wear protective clothing or garments in order to avoid contact with contaminated materials. One of the more important applications for anti-contamination protective clothing is in the nuclear power industry. Radiation from nuclear fuel activates or makes radioactive everything it comes in contact with. This includes pumps conduits, and other mechanical components of the reactor cooling system as well as air borne dust and particulates. These contaminants are like an invisible dust that effectively settles on everything in a room that has been exposed to radioactive energy.

Employees of nuclear power facilities are required to work on the working components of the facility. In order to avoid contamination from exposed materials, such employees wear an elaborate system of protective clothing. Typically such protective clothing includes light weight nylon coveralls having a very tight weave so that the coveralls have a low micron pore size that resists infiltration of particulate materials. Such persons also wear rubber gloves under and over the arm cuffs in the coveralls, and they wear booties that fit under the leg cuffs and rubber shoes that fit over the booties. A hood is worn over the head. To avoid infiltration through the cuffs of the arms and legs, the common practice has been to wrap two inch wide masking tape or duct tape around the cuffs of the arms and legs of the coveralls. The zipper of the coveralls is also covered with the same type of tape. At the end of the work day, the worker is then required to strip the tape off the uniform. This procedure is laborious and time consuming and produces hazardous waste in the form of exposed tape. Hazardous waste frequently has to be shipped to a remote disposal facility where the waste is either buried or incinerated under very special conditions and filtration. Moreover, masking tape does not always perform well especially when it gets wet, and it can lose it sealing effectiveness. The danger from radioactive materials is so serious that the most stringent precautions are taken to avoid contamination from particulate materials that one might come in contact in working in a room that has been exposed to radioactive energy.

An object of the present invention is to provide an improved cuff seal for sealing the arm and leg cuffs of protective clothing against contamination without producing disposable materials that present radioactive disposal problems.

SUMMARY OF THE INVENTION

In accordance with the present invention, a cuff seal for sealing the cuffs of anti-contamination protective clothing having cuffs at the distal ends of arms and legs comprises an elongated band that is removably attached to the cuff at an inner end and wraps around the cuff and is attached to the cuff where it overlaps the band at an outer end of the band. The band is fastened to the cuff and to the band itself by snap fasteners. The band is formed of a stretchable woven fabric which includes an elastomeric yarn in addition to non-elastomeric yarn in order to provide at least a limited stretch capability for the fabric. The band is about 2–3½ inches wide and preferably about two inches wide and covers the arm cuff completely and extends distally beyond the arm cuff so as to provide a snug seal between the band and the wearer's glove at a position distally separated from the cuff. The band similarly encircles the limb of the wearer at the cuff of the coverall legs. The band includes a plurality of longitudinally spaced snaps so that the same band can be used for different sized limbs of different wearers. The snaps are positioned so that when the band is wrapped around the cuff of an arm, the snaps are at an intermediate portion of the band and are positioned adjacent the inner side of the cuff so that the wearer can see the snaps for easily snapping the outer end of the band to the intermediate portion of the band. Two snaps are positioned at each longitudinal position along the band so as to provide alignment as well as double snap protection for insuring that the band stays fastened on the limb of the wearer.

These and other features and advantages of the present invention will hereinafter appear in connection with a detailed description of a preferred embodiment of the present invention.

DETAILED DESCRIPTION OF PREFERRED EMBODIMENT

Figure 1:
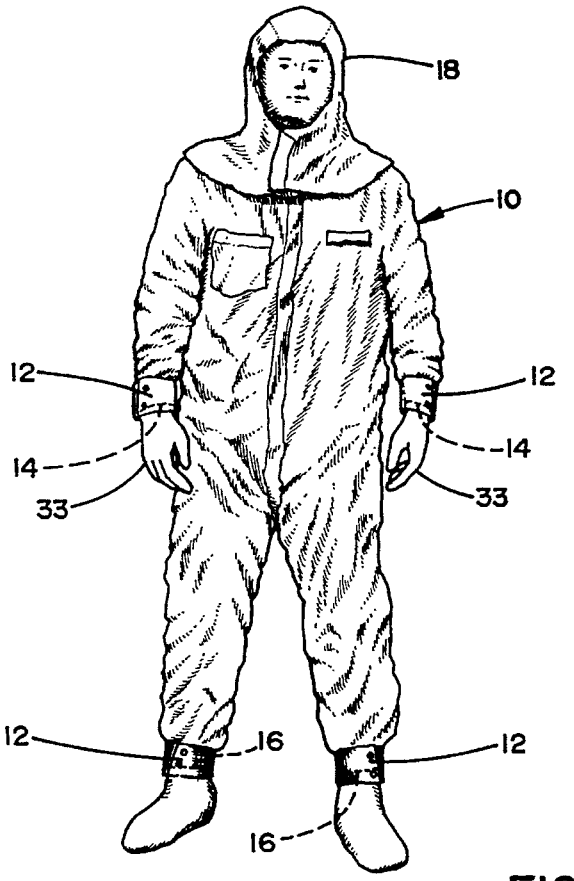
FIG. 1 is a pictorial view of a person wearing protective clothing employing the cuff seals of the present invention, with long external gloves being removed to show the cuff seals.
Figure 2:
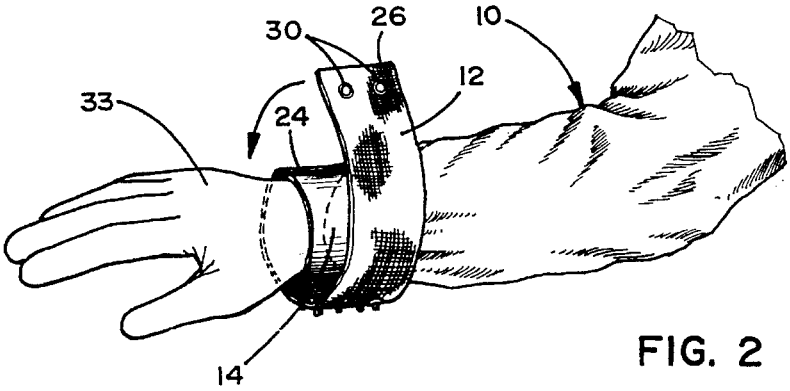
FIG. 2 is a pictorial view showing the present invention being affixed around a wrist cuff of a protective garment.
Figure 3:
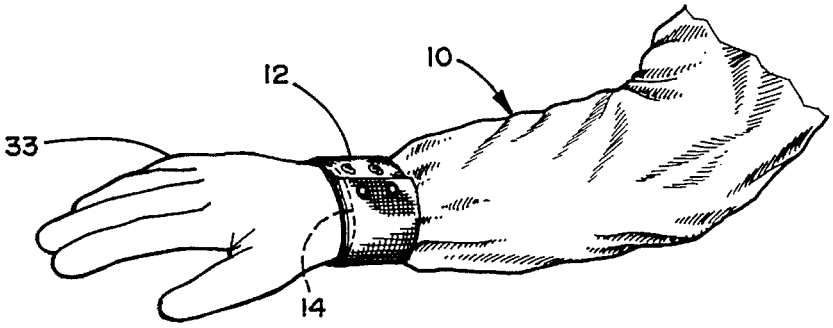
FIG. 3 is a pictorial view showing the manner in which the cuff seal of the present invention is snapped to itself around the wrist of the user.

Referring to the drawings, FIG. 1 discloses a garment 10 incorporating the unique cuff seals 12 of the present invention for sealing the arm cuffs 14 and the leg cuffs 16 of the coveralls. The protective clothing further includes a hood 18 that is worn over the coveralls. The arm cuffs of the coveralls can be formed of a ribbed elastic material 14 (FIG. 4) but with the cuff seal of the present invention, the ribbed elastic cuffs can be eliminated, in which case the cuff is formed of the garment material and is non-elastic, as shown by cuff 14' in FIG. 5. The leg cuffs of the coveralls could have an elastic cuff, but typically they do not on existing coverall systems. Instead they have cuffs of the type represented by cuffs 14' of FIG. 5. It is desirable to eliminate elastic cuffs from coveralls, because coveralls require frequent washing in order to remove radioactive contaminants. Elastic cuffs tend to trap radioactive materials and build up a residual radioactivity over a period of time. The cuffs also being of a more fragile material tend to wear out sooner than-the rest of the coveralls. The expense of an elastic cuff also is a factor.

Elastic cuffs thus make coveralls more expensive and in addition require earlier disposal of the coveralls when the cuffs either wear out or become contaminated. By using the cuff seals of the present inventions elastic cuffs on the coveralls are not required.

Cuff seals 12 comprise an elongated flat elastic band 22 formed of an elastic fabric. Desirably the bands are about 13½ inches or 14½ inches long (depending upon the application). The shorter band might be used for persons such as women having a narrower wrist than a man. A larger band is used for the wrist or ankle of a larger person. The band desirably is about two inches wide. This is the required width of duct tape or masking tape that is presently used for sealing the cuffs of protective clothing, and it is believed that a fabric cuff seal should be at least about the same width. It is possible that a band of lesser width would be satisfactory. In addition, the width could be wider and probably could be as much as about 3½ inches before the band would start to fold or wrinkle. In any case, a wider band would be unnecessary and would involve additional expense.

Figure 4:
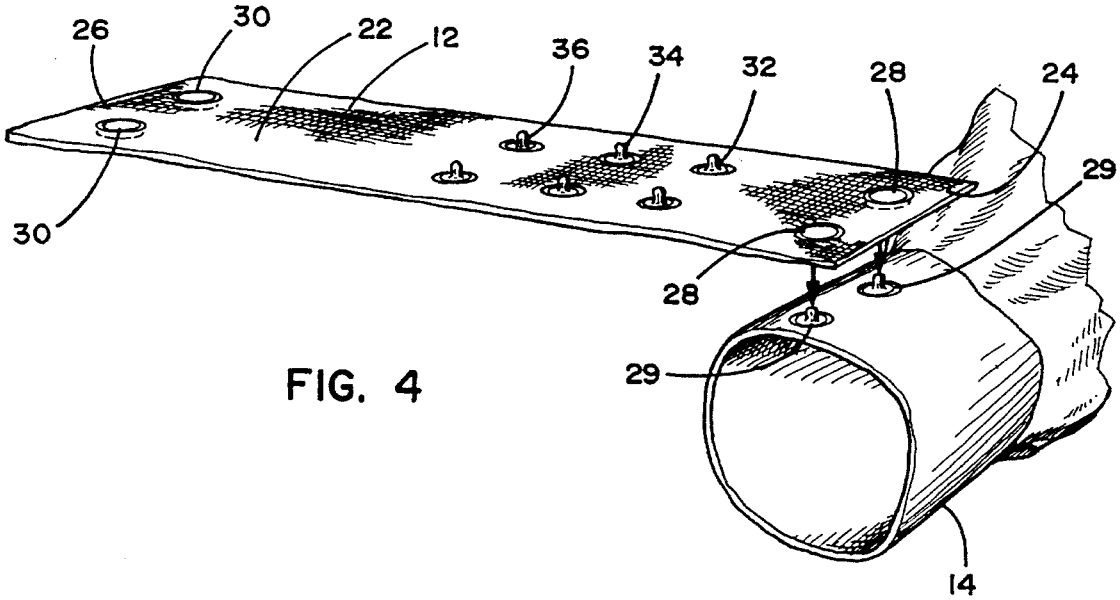
FIG. 4 is a pictorial view showing a first embodiment of the cuff seal being affixed to an elastic wrist cuff of protective clothing.

As shown in FIG. 4, band 22 has an inner end 24 and an outer end 26. Fastening means in the form of a pair of spaced snap fastener elements 28 (comprising sockets) are mounted on the underside of the fabric, as shown in FIG. 4. Fastening means in the form of snap fastener elements 30 are mounted at the outer end of the band. These elements comprise snap fastener socket elements mounted on the underside of the band, as shown in FIG. 4.

A series of longitudinally spaced snap fastener elements 32, 34, and 36 are mounted at an intermediate portion of the band. These elements in one preferred embodiment (which is 14½ inches long) are spaced 3, 4½ and 6 inches respectively from the inner end of the band. In the embodiment FIGS. 4 and 5, elements 32, 34, and 36 are stud elements of a snap fastener assembly and are mounted on the outer side of the band.

As shown in the drawings, two snap fastener elements are positioned at each longitudinal position along the band, so that the band will be held to the cuff by two snap fasteners and the band will be attached in its secured position by two snap fasteners. This provides a more secure fastening and provides a safety backup in the event that one of the fasteners does not fasten properly.

The construction of the band material is a significant feature of the present invention. The band is a woven stretch fabric that comprises both non-elastic yarns and elastomeric yarns. The fabric is a flat, hard, tightly weaved fabric in the preferred practice of the invention, and it is completely different from the loosely weaved elastic ribbed cuffs common on many garments. In the preferred practice of the present invention, the woven elastic band comprises a filling yarn, which is 150/2 black poly yarn; a warp yarn, which is also a 150/2 black poly yarn; and an elastomeric yarn, which is a 34/1140 yarn. Desirably, the fabric of the band is stretchable at least to a limit. The final stretch should be at least 150% and desirably 180% of the original length of the band. The band resiliently resists stretching while it is being stretched to its limit and cannot be stretched past the limit without substantially greater force and without breaking the fabric. This is preferred to a more elastic material. A band of this nature provides a snug and tight seal around the cuffs of the garment and eliminates any fluted or ribbed areas where particulate materials can be trapped and can pass by the band to the arm of the wearer.

A significant feature of the present invention is the manner in which the band is mounted on an arm cuff of the garment. The inner end of the band is snapped to the cuff immediately adjacent and overlapping the end of the arm. In FIG. 4, socket elements 28 engage stud elements 29 on the garment cuff, which is an elastic ribbed cuff. The distal or outer end of the band extends over the distal end of the cuff, so that the band itself will completely cover the cuff and provide a tighter seal between the band and the glove 33 of the user than the cuff itself, with its traditional ribbed configurations could provide.

The same type of connection is employed at the leg cuffs of the coveralls.

Figure 6:
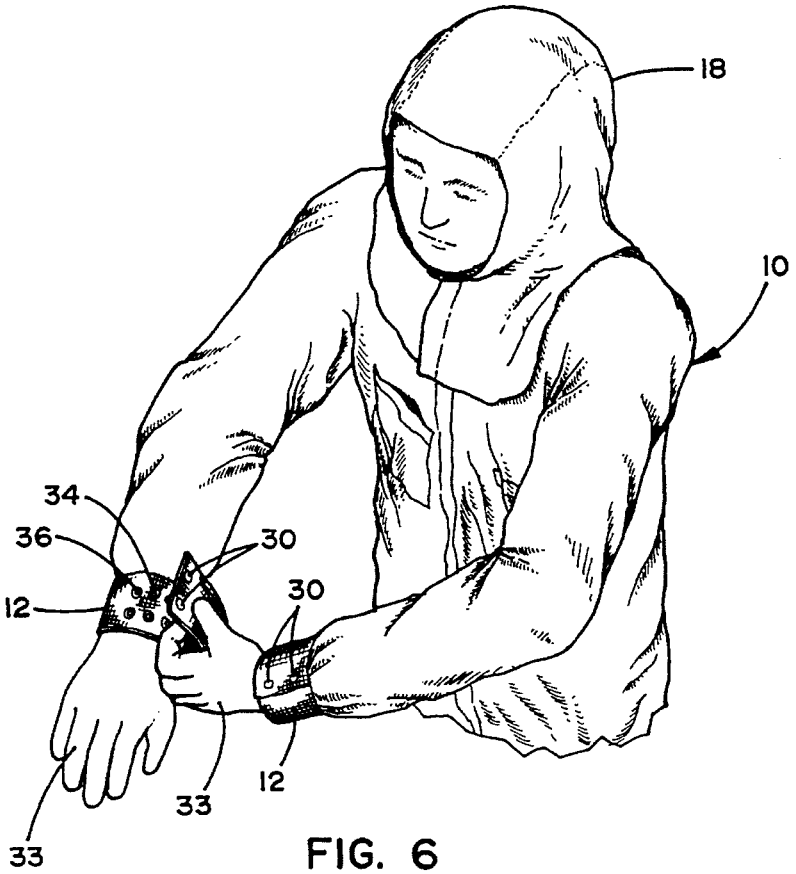
FIG. 6 is a pictorial view showing a user affixing a cuff seal around the user's wrist.
Figure 7:
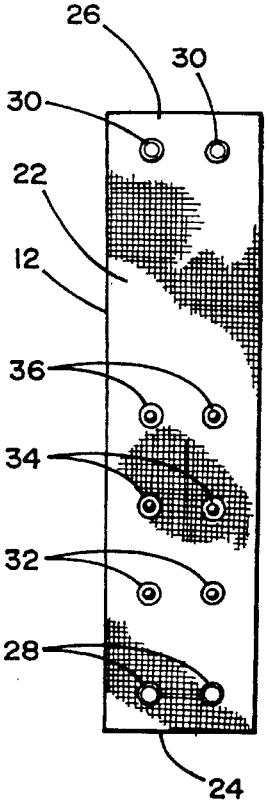
FIG. 7 is a plan view of the first embodiment of the present inventions the embodiments differing in size and in the alternate use of studs or receptacles on the garments and cuff seals.

With the snap fastener positions shown in the drawings, the cuff seals can be attached either to the arms or the legs of coveralls and wrapped around the limbs and attached appropriately. The cuff seal should completely encircle the limb of the user at least one time and preferably at least one and one-half times. The present invention contemplates an overlap of the cuff seal so that the cuff seal is wrapped approximately one and one-half times around the wrist of the user. The snaps are positioned on the band and on the cuff of the garment so that the band can be affixed to the garment with the maximum ease. Typically, the band is first attached to the garment and then wrapped in either direction around the cuff. The snaps on the garment are positioned adjacent the outerside of the arm so that when the band is wrapped around the cuff, the snaps at the intermediate portion of the cuff are positioned on the inside of the arm where they are visible and accessible to the wearers so that the snaps on the outer end of the band can be easily attached to those snaps (see FIG. 6).

Figure 5:
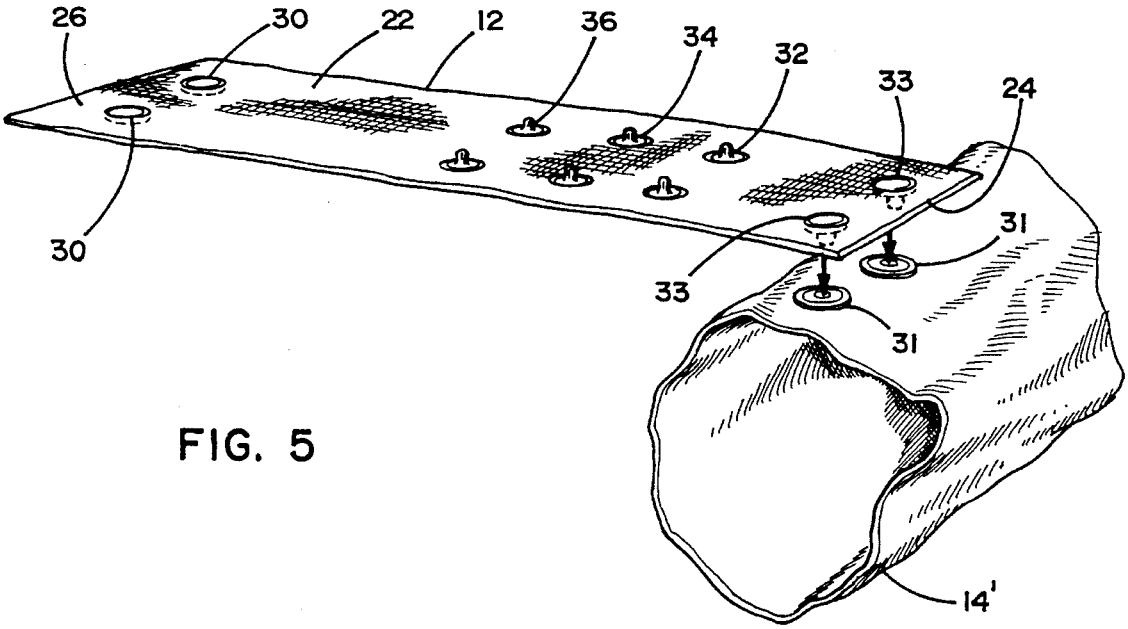
FIG. 5 is a pictorial view showing a second embodiment of the cuff seal being affixed to a non-elastic wrist cuff of protective clothing.

In the embodiment of FIG. 4, it is contemplated that snap fastener elements in the form of studs 29 are attached to the cuffs of the clothing, while socket elements 28 for the snap fasteners are attached to the bands. As shown in FIG. 5, the opposite construction could also be employed. Sockets 31 are attached to the cuffs of the garment and the band employs studs 33 at the inner end of the band. The respective location of the studs and sockets on the band and cuffs is a matter of personal preference.

The use of snap fasteners in the present invention is preferred over other types of fasteners such as a hook and loop fastener such as Velcro brand or the like. While Velcro provides in essence a continuous fastening surface, Velcro has problems in the nuclear power area. Velcro tends to trap radioactive particles as well as lint and other things that Velcro picks up. Accordingly, it is difficult to wash radioactive material out of Velcro, and this would shorten the life of the garment and the band. With Velcro, it would be necessary to attach the Velcro to the garment, and a residual build up of radioactive material in the Velcro could prematurely end of the life of the protective clothing. For applications other than the nuclear industry, Velcro would be satisfactory.

If Velcro is used, the continuous fastening surface makes it less necessary to have any elasticity in the band. While elasticity would still be desired in order to provide a snug and resilient fit, under some circumstances the need for an elastic fabric might be reduced.

Among the advantages of the present invention is that the cuff seals are easy to remove and install on the clothing, and they do not damage the clothing by the constant application and removal of tape from the clothing. Further the cuff seals can be washed independently and replaced when needed, independent of a separate replacement schedule that may be applicable for the coveralls themselves. The cuff seals do an excellent job of sealing the arm and leg cuffs of the protective clothing and can be washed and reused any number of times.

It should be understood that the foregoing represent preferred embodiments of the present invention and that one skilled in the art may make additional modifications and changes in the arrangements and details of the embodiments disclosed herein without departing from the spirit and scope of the present invention, which is defined in the appended claims.

We claim:

1. In a one-piece body-covering garment for protecting the body and limbs of a wearer from external contamination, wherein the garment is fabricated from a non-elastic fabric having a sufficiently small pore size to resist particulate infiltration, the garmet having legs and arms and having cuffs at distal ends of the legs and arms, at least one of the cuffs being substantially non-elastic, the improvement comprising a cuff seal releasably attached to at least one of the non-elastic cuffs, the cuff seal comprising an elongated elastically stretchable band having inner and outer ends, the inner end of the band being attached to the cuff by releasable cuff fasteners, such that the band can be removed from the garment, and the garment and band can be washed and replaced independently of each other, the band being long enough to be wrapped at least once completely around a limb of a wearer that protrudes through the cuff, the cuff seal further including releasable seal fastener means for fastening the outer end of the band to an intermediate portion of the band at a position where the outer end overlaps the band and the band is stretched snugly around the limb, such that the band closes the cuffs snugly and resiliently on the wearer's limb and effectively restricts contaminant infiltration into the garment through the cuffs.

2. A garment according to claim 1 wherein the releasable cuff fasteners comprise snap fasteners positioned in opposed relationship on the inner end of the band and the cuff.

3. A garment according to claim 1 wherein the releasable seal fastener means comprise mating snap fasteners on the outer end and intermediate portions of the band, at least one of the outer end of the band and the intermediate portion of the band including a plurality of snap fasteners longitudinally spaced along the band such that the tightness of the band around a limb can be adjusted.

4. A garment according to claim 1 wherein the band is at least about two inches (2") wide.

5. A garment according to claim 1 wherein the band is attached to the cuff of the garment arm such that when the band is wrapped around the cuff, the band extends distally at least to a distal end of the cuff.

6. A garment according to claim 5 wherein the band extends distally past the distal end of the cuff of the garment arm such that the band snugly encircles and engages the limb of the wearer at a position distally of the cuff.

7. A garment according to claim 1 wherein the band encircles the limb of the wearer at least about one and one-half times when it is fastened on the wearer's limb.

8. A garment according to claim 1 wherein the band comprises a non-ribbed woven fabric that includes elastic fibers that give the fabric at least a limited resilient stretch capability, the stretch characteristics of the fabric being such that the fabric encloses the limb of the wearer sufficiently snugly that contaminant infiltration through the cuff is substantially prevented.

9. A garment according to claim 2 wherein the cuff fasteners and seal fastener means include a pair of spaced snap fit fasteners at spaced longitudinal fastener positions on the band and on the cuff where the band is fastened to the band and cuff.

10. In a body-covering garment for protecting the body and limbs of a wearer from external contamination, wherein the garment has legs and arms and has cuffs at distal ends of the legs and arms, the improvement comprising a cuff seal releasably attached to at least one of the cuffs, the cuff seal comprising an elongated elastically stretchable band having inner and outer ends, the inner end of the band being releasably attached to the cuff, the band being long enough to be wrapped at least once completely around a limb of a wearer that protrudes through the cuff, the cuff seal further including releasable seal fastener means for fastening the outer end of the band to an intermediate portion of the band at a position where the outer end overlaps the band and the band is stretched snugly around the limb, such that the band closes the cuffs snugly and resiliently on the wearer's limb and effectively restricts contaminant infiltration into the garment through the cuffs, at least one of the cuffs of the garment being non-elastic and not resiliently enclosing the wearer's limb, the cuff seal providing the only means for closing the at least one non-elastic cuff on the limb, the cuff seal being attached to the at least one non-elastic cuff by releasable fastener means, whereby the cuff seals can be laundered or replaced independently of the rest of the garment and the garment life is not shortened because of residual contamination or wearing out of permanently affixed elastic cuffs.

11. In combination with an anti-contaminant body covering protective garment wherein the garment has cuffs at distal ends of arms and legs of the garment, and at least one of the cuffs being substantially non-elastic, the improvement comprising a cuff seal for sealing at least one of the non-elastic cuffs of the garment, the cuff seal comprising:

an elongated elastically stretchable band having inner and outer ends;

releasable cuff fastener means mounted on the cuff and the inner end of the band for releasably attaching the inner end of the band to the cuff, such that the cuff seal can be removed from the garment and can be washed and replaced separately from the garment; and releasable seal fastener means on the outer end of the band and on an intermediate portion of the band for fastening the outer end of the band to the intermediate portion of the band after the band has completely encircled the limb of the wearer and the outer end of the band overlaps the inner end of the band.

12. The combination according to claim 11 wherein the cuff seals are releasably mounted on all of the arm and leg cuffs of the garment.

13. A cuff seal according to claim 11 wherein the band is at least about two inches (2") wide and is mounted on the garment arm cuff so as to overlap the cuff and extend distally past the cuff.

* * * * *